US005293799A

United States Patent [19]

Ury

[11] Patent Number: 5,293,799

[45] Date of Patent: Mar. 15, 1994

[54] PUNCHING AND PERFORATING UNIT WITH COMBINED PUNCHING AND PERFORATING CYLINDERS

[76] Inventor: Frank Ury, 7326 Quill Dr., #133, Downey, Calif. 90242

[21] Appl. No.: 917,843

[22] Filed: Jul. 21, 1992

[51] Int. Cl.[5] ..... B26D 1/62; B26F 1/00

[52] U.S. Cl. ..... 83/345; 83/346; 83/667; 83/670; 83/678

[58] Field of Search ..... 83/346, 343, 345, 667, 83/669, 670, 678

[56] References Cited

U.S. PATENT DOCUMENTS

| | | | |
|---|---|---|---|
| 2,735,488 | 2/1956 | Anderson et al. | 83/678 X |
| 3,706,250 | 12/1972 | Herd | 83/345 |
| 3,954,034 | 5/1976 | Broderick | 83/678 X |
| 4,074,599 | 2/1978 | Allen | 83/346 |
| 4,594,926 | 6/1986 | Propheter | 83/345 |
| 5,133,235 | 7/1992 | De Vito | 83/347 |

*Primary Examiner*—Eugenia Jones

[57] ABSTRACT

A punching and perforating cylinder and a die and anvil cylinder are part of a computer paper processing system producing the line holes and the cross perforation in a continuous paper web. The PUNCH/PERF cylinder is mounted on an upper shaft, while the DIE/ANVIL cylinder is mounted on a lower shaft. The upper and lower shafts are rotatably engaged by a set of gears. At both ends of the PUNCH/PERF cylinder, holes are located to accept the PUNCHES. At both ends of the DIE/ANVIL cylinder, holes are located to accept the DIES. While the two cylinders are rolling together, the punches engage with the dies and form the punched line holes in the continuous paper web. The PUNCH-/PERF cylinder has longitudinally formed slots, providing the space for the cross perforating blades and for the cross perforating blade clamping bars. The DIE-/ANVIL cylinder has longitudinally formed slots, providing the space for the hardened anvil bars. While the two cylinders are rolling, the cross perforating blades are engaged with the anvil bars and form the cross perforation in the continuous paper web. At both ends of the cross perforating blade locking bars, holes are located to accept the punches, providing the punch hole locations in the cylinder, circumferentially. At both ends of the anvil bars, holes are located to accept the dies, providing the die hole locations in the cylinder, circumferentially. The combined punching and perforating cylinder set enables it to complete both the punching and perforating operations in a continuous paper web by only one set of rotating cylinders.

1 Claim, 4 Drawing Sheets

PUNCHING AND PERFORATING UNIT WITH COMBINED PUNCHING AND PERFORATING CYLINDERS

BACKGROUND OF THE INVENTION

1) Field of Invention

The present invention relates generally to punching and perforating units.

With the increasing use of folded paper for web printing, computer, word processing and other high speed printing applications, a need has arisen for punching and perforating units for punching and perforating a continuous web of paper, which are simple to manufacture, economical, easy to set-up, operate, and efficient. Further, the ability of changing and setting-up the paper processing system for different format sizes, without the need of highly skilled technicians, is obtainable.

2) Description of the Prior Art

In the past, the computer paper processing was accomplished by three operations. Specifically:

First, at the punching station the line holes were punched at both edges of the continuous paper web.

Second, at the cross perforating station, the cross perforation was created across the paper web.

Third, between the punching and perforating stations a length compensator was used, in order to bring the cross perforation line in register and between the punched line holes.

In addition, for bridging the drive between the punching and the perforating stations, either an idler gear, or some means of drive was needed.

In the past, the computer paper processing systems needed separate setting-up for each stations independently. Specifically:

At the punching station, two sets of punch and die rings were utilized for punching the line holes at both edges of the continuous paper web simultaneously. The distance between the (upper) punch rings, and the distance between the (lower) die rings were set individually for the edge-to-edge distance, while an alignment had to be observed between the punch and die rings. As for the next setting, the punches had to be brought in line with the dies exactly for proper punch-die engagement. This was accomplished by the SLIP gears, which are rotatably adjustable. Finally, an ANTI-BACKLASH type gear adjusted the relative rotational clearance between the punching ring shaft gear teeth and the die ring shaft gear teeth, for proper operation.

At the perforating station, the cross perforating blades were installed into the slots of the perforating cylinder. For the next setting, an ANTI-BACKLASH type gear was used, for eliminating the gear teeth clearance between the perforating cylinder gear and the anvil cylinder gear, for proper operation. Both the perforating cylinder and the anvil cylinder were full cylinders. The anvil cylinder was hardened all around. Both cylinders embodied the elements of the shaft, gear, bearings, retainer, shield and all related components.

The compensator was utilized as part of the set-up to bring the cross perforation line in register with the punched line holes. This was done while the equipment was running slowly, and the results of the correction were observed by the naked eye. Thus, the magnitude of the accuracy depended on the skill of the technician.

SUMMARY OF THE INVENTION

The present invention solves this need of a punching and perforating unit for punching and perforating a continuous web of paper which is simple to manufacture, economical, easy to set-up, operate, and efficient. Further, the present invention solves the need to facilitate the ability of changing and setting-up paper processing equipment for different format sizes quickly, easily, and without the need of highly skilled technicians.

The present invention solves this need by providing an improved method in the preferred embodiment for allowing the punching and perforating operations of a continuous web of paper by only one pair of rotating cylinders. Specifically: a pair of cylinders is provided for facilitating the places and accepting the components for producing the line holes at both edges and the cross perforation in a continuous web of paper.

The present invention solves this need by providing, in the preferred embodiment, the elimination for separate cylinders for punching and perforating of a continuous paper web. Specifically, both functions, punching and perforating, are accomplished by one cylinder pair, reducing parts and manufacturing costs.

The present invention solves this need by providing, in the preferred embodiment, the elimination for separate shafting, bearings, gears and related components for punching and perforating of a continuous paper web. Specifically: both functions, punching and perforating, utilize the same shafting, bearings, gears and related components, thus reducing the elements of the equipment and the cost.

The present invention solves this need by providing, in the preferred embodiment the elimination of the necessity for a compensator section or adjustment of any kind for registering the cross perforating line to the location of the line holes. Specifically: since the elements for producing the line holes at both edges of the paper web, as well as the elements for producing the cross perforation in the continuous paper web are part of the same cylinder, there is a pre-determined and fixed relation between the line hole and the cross perforation producing elements. The locations of these elements are MACHINED into the cylinder with accuracy and are operating at their proper location, reducing the time for machine set-up.

The present invention solves this need by providing in the preferred embodiment a method for eliminating the necessity of setting-up the distance between the punch rings and between the die rings individually for the edge-to-edge distance. Specifically: the location of the holes in the punch/perf and in the die/anvil cylinders for the punches and dies are MACHINED into the cylinders with accuracy, for producing the line holes simultaneously at both edges of the continuous web of paper. Thus, machine set-up time is reduced.

The present invention solves this need by providing, in the preferred embodiment, a method for eliminating the necessity of setting the (lower) die rings to the (upper) punch rings individually. Specifically: once the punch hole and die hole locations are set at one end of the cylinder, at the other end of the cylinder both punch and die hole locations are automatically at their proper locations, since the locations are MACHINED into the cylinder body with accuracy, reducing the set-up time.

The present invention solves this need by providing, in the preferred embodiment a method, for eliminating the necessity of adjusting and setting the location of the cross perforating blade in reference to the punch and die location. Specifically: since the location of the cross perforating blades and the location of the punches and dies are in the same cylinder pair, these locations are pre-determined, fixed and MACHINED into the cylinder body, with accuracy, reducing the set-up time.

THUS, it is the object of the present invention, to provide a novel combined punching and perforating cylinder.

It is also the object of this invention, to provide such a novel PUNCH/PERF unit, for punching and perforating by one pair of PUNCH/PERF cylinders.

It is also the object of this invention, to provide such a novel PUNCH/PERF unit, by utilizing a hardened anvil bar, in lieu of a hardened anvil cylinder, making it less costly to manufacture, repair or replace.

It is also the object of this invention, to provide such a novel PUNCH/PERF unit with cross perforating blade clamping bars, including holes at both ends for accepting punches.

It is also object of this invention, to provide such a novel PUNCH/PERF unit with hardened anvil bars, including holes at both ends for accepting dies.

It is also the object of this invention, to provide such a novel PUNCH/PERF unit, for setting-up the punching and perforating unit quickly and easily, and by a relatively unskilled technician.

It is also the object of this invention, to provide such a novel PUNCH/PERF unit for eliminating the need for setting the distances between the punch rings and between the die rings individually, for punching the line holes at both edges of a paper web.

It is also the object of this invention to provide such a novel PUNCH/PERF unit for eliminating the need for setting the (lower) die rings to the (upper) punch rings individually, at both ends, for producing the line holes at both edges.

It is also the object of this invention to provide such a novel PUNCH/PERF unit, which is of a simple design, is easy to manufacture, assemble, repair and operate, maximizes material and is efficient.

These and further objects and advantages of the present invention are made clear in the following detailed description of an illustrative embodiment of this invention described in connection with the drawings.

BRIEF DESCRIPTION OF THE DRAWINGS

The illustrative embodiment may best be described by referring to the accompanying drawings.

Figure 1:
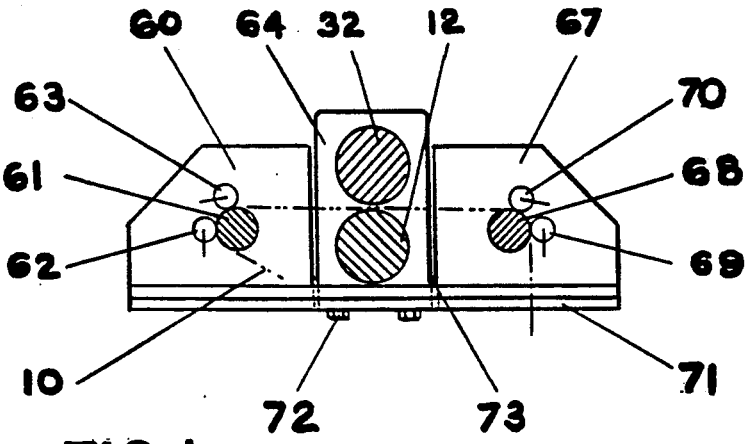
FIG. 1. Shows a schematic overview of the PUNCHING AND PERFORATING unit constructed according to the teachings of the present invention.

All figures are drawn for ease of explanation of the basic teachings of the present invention only; the extension of the figures with respect to the number, position, relationship and dimensions of the parts to form the preferred embodiment will be explained or will be within the skill of the art after the following teachings of the present invention have been read and understood. Further the exact dimensions and dimensional proportions to conform to specific force, weight, strength and similar requirements will likewise be within the skill of the art after the following teachings of the present invention have been read and understood.

Where used in the various figures of drawings, the same numerals designate the same or similar parts. Furthermore, when the term "top", "bottom", "front", "rear", "horizontal", "vertical", "longitudinal", "upper", "lower", and similar terms are used herein, it should be understood that these terms have reference only to the structure shown in the drawings as they would appear to a person viewing the drawings. The terms are utilized only to facilitate describing the invention.

DESCRIPTION OF THE PREFERRED EMBODIMENT

The punching and perforating unit, and part of the paper processing system, according to the teachings of the present invention are generally shown in the drawings and generally designated FIG. 1.

The infeed section 60, generally includes a driven infeed cylinder 61, around which the paper web 10, is wrapped, members 62, for keeping the paper engaged with the driven infeed cylinder 61, members 63, for slitting the edges of the paper web 10.

The Punching and Perforating Unit 64, generally includes a driven punching/perforating cylinder, and a driven die/anvil cylinder 12.

The outfeed section 67 generally includes a driven outfeed cylinder 68, around which the paper web 10 is wrapped, members 69, for keeping the paper engaged with the outfeed cylinder 68, members 70 for perforating the paper web lengthwise at both edges.

Units 60, 64 and 67 are mounted onto a suitable base 71 by mounting screws 72. The locating pins 73 will position all three sections: Infeed Section 60, Punching-/Perforating Unit 64 and Outfeed Section 67.

Further, the base 71 is part of the paper processing system.

Figure 3:
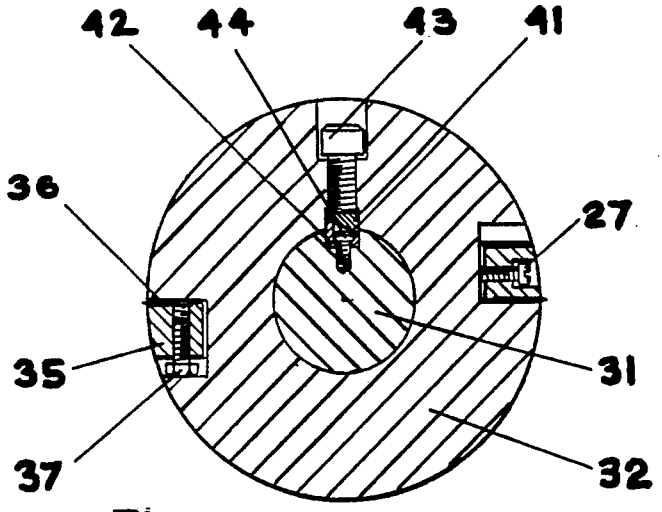
FIG. 3 Shows a sectional view of the PUNCH-/PERF cylinder.
Figure 2:
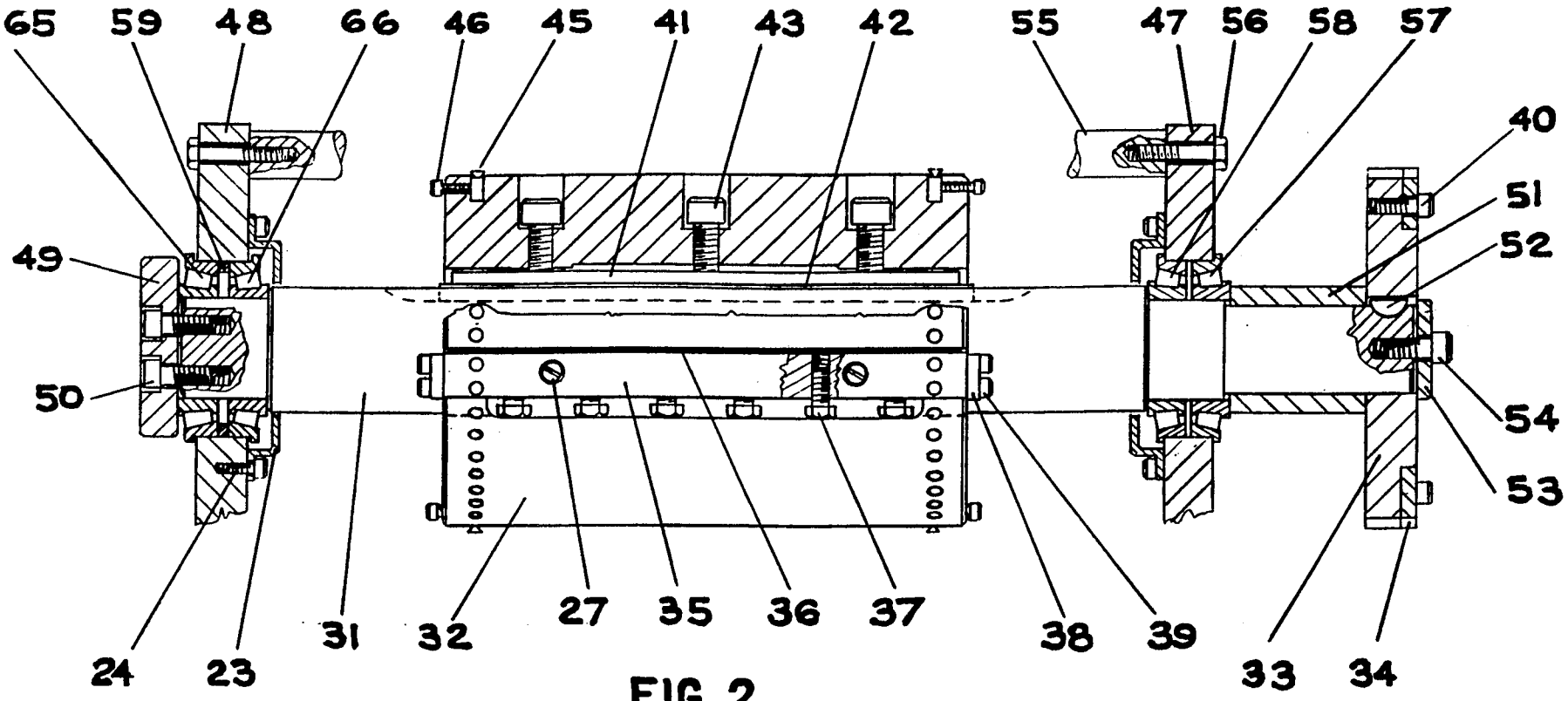
FIG. 2. Shows a side view of the PUNCH/PERF cylinder and sectional views of the shaft ends.

The combined Punching and Perforating Cylinder, according to the teachings of the present invention is generally shown in FIG. 2 and FIG. 3.

The combined Punching/Perforating Cylinder 32 is mounted on the shaft 31 which facilitates the means of support and drive for the Punching/Perforating Cylinder 32.

The driver gear 33 is mounted at the end of the shaft 31 and held by a retaining disk 53.

The Punching/Perforating Cylinder 32 is provided with suitable slots which accept the cross perforating blades 36 and the cross perforating blade clamp bars 35.

Further, at both ends of the Punching/Perforating Cylinder 32 the clamp bar locating plates 38 are bolted to the cylinder 32.

The Punching/Perforating Cylinder 32 in accordance with the teachings of the present invention has a unique construction in its most preferred form as best seen in FIG. 2 and FIG. 3.

Specifically, the cylinder 32 is formed from a round steel bar. The cylinder has a through bore longitudinally with a keyway included. This keyway accepts the upper part 41 of a key pair. The key pair 41 and 42 has a slope at its contact surfaces, thus facilitating the ability to tighten the Punch/Perf cylinder 32 to the shaft 31.

Further, in the Punch/Perf cylinder body 32 and exactly above and in line with the keyway there are the locking screws 43. When it is tight against the key the cylinder is held in place both longitudinally and circumferentially at all times after it is properly set to its operating location.

The cylinder 32 has slots longitudinally, to accept the cross perforating blades 36 and the cross perforating blade clamping bars 35. In the cylinder body a cavity is machined for the heads of the locking screws 37. The cavity serves also as access for the wrench while locking or unlocking the clamp bars 35.

At both edges of the combined Punching/Perforating Cylinders 32 a row of holes is furnished circumferentially to accept the punches 45. The punches 45 are held in place by the screws 46.

At the ends of the Punching/Perforating Cylinder 32 and in-line with the slots the locating plates 38 are bolted to the cylinder body 32 by the screws 39. The locating plates 38 serve two purposes: First, to locate the clamp bar 35 longitudinally; Second, to hold the clamp bar 35 to the cylinder body 32 while adjusting or clamping the cross perforating blades 36. Screws 27 serve for adjusting the protrusion of the perforating blades 36. Since the clamp bars have a milled lip at the cross perforating blade, the clamp bar is capable of lifting or lowering the cross perforating blades 36. Thus facilitating the adjustment of blade protrusion.

The shaft 31 is mounted on rolling element bearings.

On one end of the shaft 31 the bearings 57 and 58 are locked against the side wall 47 of the punching/perforating unit frame, thus holding the shaft against axial movement. The bearings 57 and 58 are locked against the side wall 47 by the disk 53 and tightened by the screw 54. The space between the bearing 57 and the disk 53 is taken-up by a spacer 51 and a gear 33.

At the other end of the shaft 31, the bearings 65 and 66 are not locked against the side wall 48 of the punching and perforating unit frame, thus allowing an axial movement of this shaft end. This is accomplished by using a spacer 59 between bearings 65 and 66. The bearing 65 is locked against the shaft 31 by the disk 49 and by the screws 50.

In the preferred embodiment of this invention, the shaft 31 has a machined slot for accepting the lower part 42 of the sloped key-pair. The key-pair has a slope at its contact surface, thus facilitating the ability to tighten the Punching/Perforating Cylinder 32 to the shaft 31. The key 42 is bolted to the shaft 31 by suitable screws 44.

The gear 33 is mounted on the shaft and utilizes a key 52.

The gear is the ANTI-BACKLASH type having a thicker face portion 33 and a thinner face portion 34. The thinner face portion 34 can be rotated in reference to the thicker face portion 33 circumferentially. The anti-backlash gear 34 is held by a suitable screw 40.

The shield 23 keeps the bearing grease in place. The screws 24 mount the shield to the frames.

For the purpose of keeping all punching and perforating elements in one unity, side plates 47 and 48 are provided. Between the side plates 47 and 48 tie bars 55 are keeping the proper distance, which are secured to the side plates by the screws 56.

According to the teachings of this invention the functions of the clamp bars 35 are of utmost significance. Specifically: the first function of this bar is to clamp the cross perforating blade 36 into the cylinder slot. The second function is to facilitate holes for the punches 45 where they fall circumferentially on the area where the clamp bar 35 takes place, enabling it to produce the two functions by one cylinder pair. Specifically, both the line hole punching and the cross perforating operations are performed by one cylinder pair.

To complete the punching and cross perforating operations, the second half of this cylinder pair, the combined DIE AND ANVIL CYLINDER and its function is also an essential part of this invention and is described next.

Figure 5:
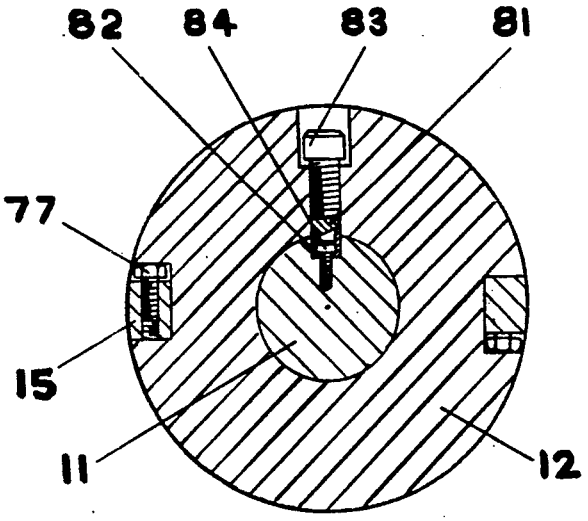
FIG. 5 Shows a sectional view of the DIE/ANVIL cylinder.
Figure 4:
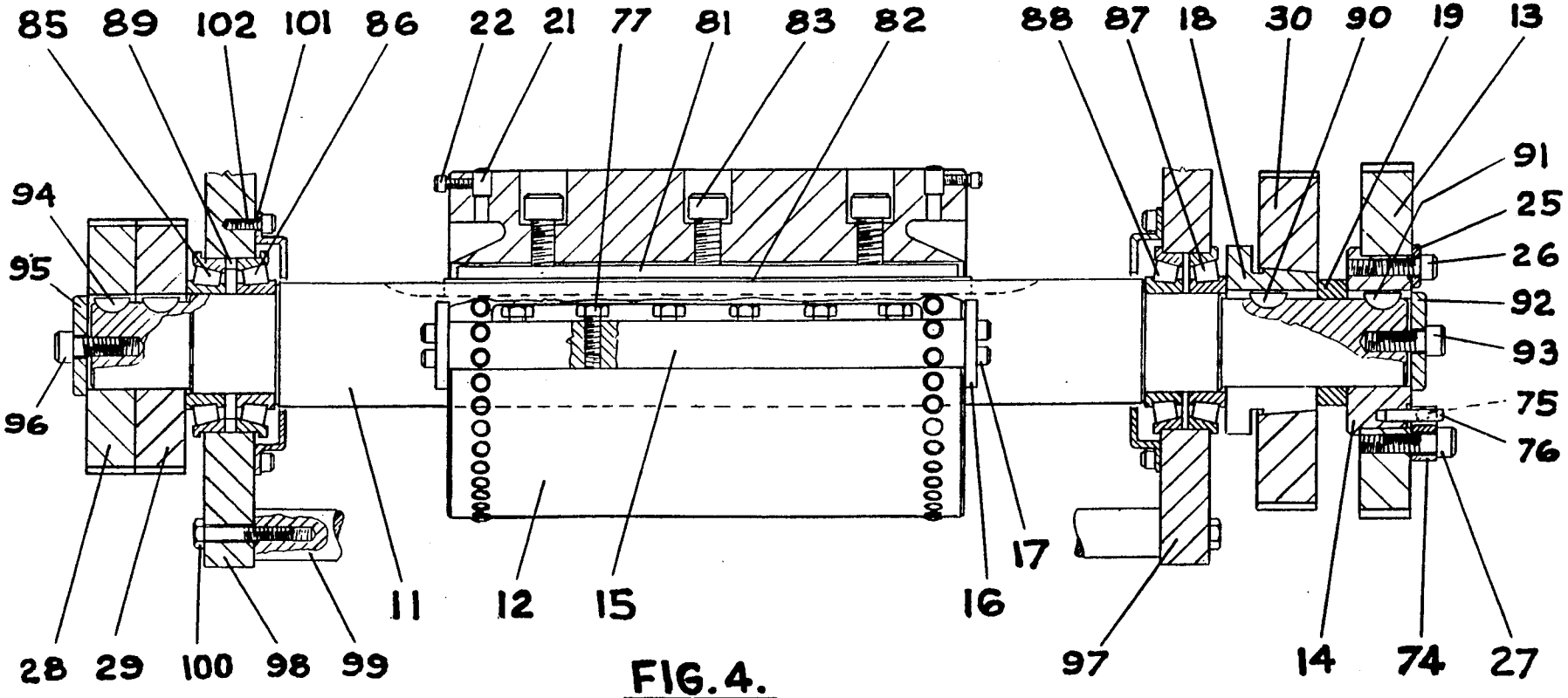
FIG. 4 Shows a side view of the DIE/ANVIL cylinder and sectional views of the shaft ends.
Figure 6:
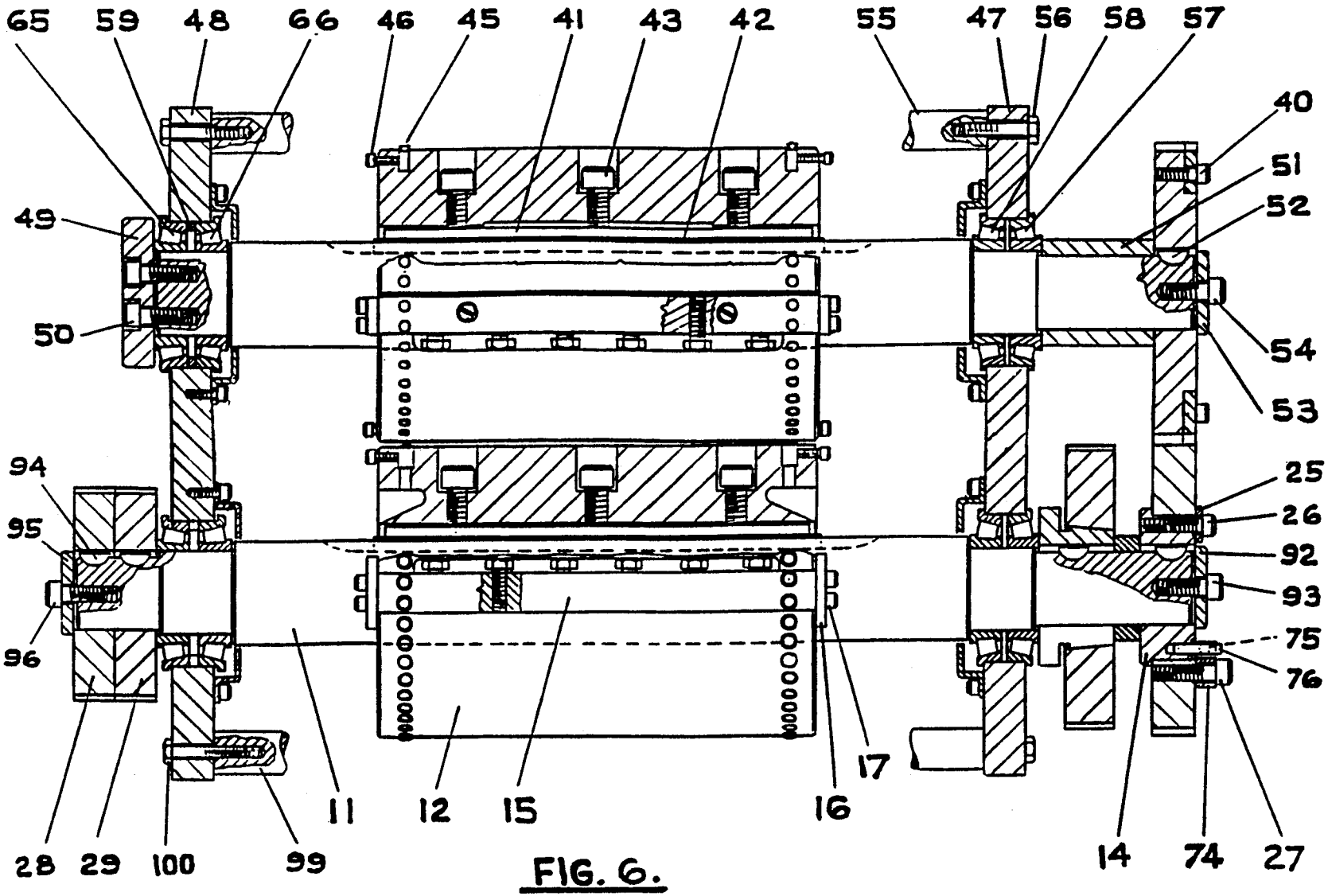
FIG. 6 shows a side view of the Punching/Perforating cylinder and the Die/Anvil cylinder.

The combined DIE AND ANVIL CYLINDER, according to the teachings of the present invention is generally shown on FIG. 4 and FIG. 5.

The combined DIE AND ANVIL CYLINDER 12 is mounted on the shaft 11 which facilitates the means of support and the drive for the Die/Anvil Cylinder 12.

The driver gear 13 is mounted at one end of the shaft 11 and held by a retaining disk 92.

The Die/Anvil Cylinder 12 is provided with suitable slots, which accepts the anvil bars 15.

Further, at both ends of the Die/Anvil Cylinder 12 the anvil bar locating plates 16 are bolted to the anvil bar 15.

The Die/Anvil Cylinder 12 according to the teachings of the present invention has a unique construction in its most preferred form as best seen in FIG. 4 and FIG. 5.

Specifically, the cylinder 12 is formed from a round steel bar. The cylinder has a through bore longitudinally with a keyway included. This keyway accepts the upper part 81 of a key pair 81 and 82. The key-pair has a slope at its contact surface, thus facilitating the ability to tighten the Die/Anvil Cylinder 12 to the shaft 11.

Further, in the Die/Anvil Cylinder body 12, and exactly above and in line with the keyway, there are the locking screws 83. When the screw 83 is tight against the key 81 the cylinder is held in place both longitudinally and circumferentially at all times after it is properly set to its operating location.

The Die/Anvil Cylinder 12 has slots longitudinally to accept the anvil bars 15. In the cylinder body a cavity is machined for the heads of the locking screws 77. The cavity serves also as access for the wrench while locking or unlocking the anvil bars 15.

At both edges of the combined Die/Anvil Cylinder 12 a row of holes is furnished circumferentially, to accept the dies 21. The dies 21 are held in place by the screws 22.

At the ends of the anvil bars 15, the holding plates 16 are located. The holding plates 16 are bolted to the anvil bars 15, by the screws 17. The holding plates serve two purposes: first they locate the anvil bar 15 longitudinally, and second, they hold the anvil bar 15 in the slot while clamping the bar into the slot.

The shaft 11 is mounted on rolling element bearings.

On one end of the shaft 11 the bearings 87 and 88 are locked against the side wall 97 of the punching/perforating unit frame, thus, holding the shaft against axial movement. The bearings 87 and 88 are locked against the side wall 97 by the disk 92 and tightened by the screw 93. The space between the bearing 87 and the disk 92 is taken-up by a bushing 18, by a spacer 19, and by a gear hub 14.

At the other end of the shaft 11 the bearings 85 and 86 are not locked against the side wall 98 of the punching/perforating unit frame, thus allowing an axial movement of this shaft end. This is accomplished by using a spacer 89 between bearings 85 and 86. The bearing 85 is locked against the shaft 11 by the disk 95 and by the screws 96.

The space between the bearing 85 and the disk 95 is taken up by the gearbelt pulleys 28 and 29.

The gearbelt pulleys 28 and 29 are secured to the shaft by the keys 94.

In the preferred embodiment of this invention, the shaft 11 has a machined slot for accepting the lower part 82 of a sloped key-pair. The key-pair has a slope at its contact surface, thus facilitating the ability to tighten the Die/Anvil Cylinder 12 to the shaft 11. The key 82 is bolted to the shaft 11 by suitable screws 84.

The Gear 13 and the Gear Hub 14 are mounted on the shaft by utilizing the key 91. The gear is the slip-gear type for adjusting the upper PUNCH/PERF CYLINDER 32 to the lower DIE/ANVIL Cylinder 12. For fine adjustment a yoke 74 is furnished with adjusting screw 75 and pin 76. The yoke is held to the gear by a screw 27. The screw 26 locks the gear 13 to the gear hub 14, through the washer 25.

The main drive gearbelt pulley 30 is mounted on the shaft 11 by a bushing 18 and by utilizing a key 90.

Between the main drive gearbelt pulley bushing 18 and the gear hub 14 a spacer 19 is located.

The shield 101 keeps the bearing grease in place. The screws 102 secure the shield to the frames.

The side plates 97 and 98 hold the elements of the Punch/Perf in one unity. The tie bars 99 keep the proper distance between the side frame 97 and 98. The tie bars 99 are secured to the side frames by the screws 100.

According to the teachings of this invention, the functions of the anvil bar 15 are of utmost significance. Specifically: the first function of this bar 15 is to provide a hard surface against which the cross perforating blade can operate, thus creating the cross perforation line. The second function of the anvil bar 15 is to facilitate holes for the dies 21 where it falls circumferentially on the area where the anvil bar 15 takes place, enabling it to produce the two functions by one cylinder pair. Thus: both the line hole punching and the cross perforating operations are performed by one cylinder pair.

Finally, the PUNCHING AND PERFORATING UNIT 64 in FIG. 1 according to the teachings of the preferred embodiment of this invention is easily removable and can be exchanged with other punching and perforating units to perform punching and perforating operations for different format sizes of computer paper forms. The locating pins 73 assure quick change and exact location for the different format size units 64 without the need of a relatively highly skilled technician.

It should be noted that prior to this invention separate punch and die ring sets were utilized for punching the line holes at the two edges of the paper web; thus, there was a need to set the distance between both sets of punch and die rings individually.

It should be noted that prior to this invention is was necessary to set the distance between the punch rings and between the die rings separately for punching the line holes at the two edges of the paper web.

It should be noted that prior to this invention a separate section was used for punching the line holes, and a separate section was used for performing the cross-perforation operation in the paper web.

It should be noted that prior to this invention it was necessary to set separately the punch and die ring shafting, the slip and anti-backlash gearing. Also, it was necessary to set separately the cross-perforating and the anvil cylinder, the slip and anti-backlash gearing.

It should be noted that prior to this invention a compensator section was needed between the punching and perforating sections in order to bring the cross-perforation line in register with the line hole locations.

It should be noted that prior to this invention the compensator adjustments had to be performed by a relatively skilled technician with a time consuming trial-and-error method.

It should be noted that prior to this invention a full hardened cylinder was needed as anvil. In the preferred embodiment only an anvil bar is utilized with hardened surface where the cross-perforation takes place between the cross-perforating blades and the anvil bar.

It should be noted that prior to this invention if the anvil cylinder was damaged, a complete cylinder had to be replaced. According to the teachings of this invention when the anvil surface is damaged, only a hardened anvil bar has to be replaced.

Now that the construction of the Punching and Perforating Unit according to the preferred embodiment has been set forth, the operation, advantages and subtle features of the present invention can be set forth and appreciated.

For example: utilizing the combined Punching/Perforating Cylinder 12 in conjunction with the combined Die/Anvil Cylinde 32, the machine set-up time is much less and can be done by less skilled technicians. Further, the machine elements are performing dual functions, thus fewer parts are needed and in turn, less costly to manufacture. Changing sizes for different format sizes can be done quickly and easily. In addition, maintenance repairs are less costly and can be accomplished by relatively unskilled technicians.

Thus, since the invention disclosed herein may be embodied in other specific forms without departing from the spirit of general characteristics thereof, some of which forms have been indicated, the embodiment described herein is to be considered in all respects illustrative and not restrictive. The scope of the invention is to be indicated by the appended claims, rather than by the foregoing description, and all changes which come within the meaning and range of equivalency of the claims are intended to be embraced therein.

I claim:

1. A punching and perforating unit for punching and perforating a continuous web of paper, comprising:

left and right side plates;

tie bars secured to and located between said side plates;

an upper shaft; a punching and perforating cylinder mounted on said upper shaft;

a lower shaft; a die and anvil cylinder mounted on said lower shaft;

bearings mounted in each of the side plates for supporting the shafts;

an upper sloped key pair including a sloped key received in a slot in the upper shaft, a mating sloped key received in a through bore in the punching and perforating cylinder, and a screw located above the key pair for locking the key pair to the punching and perforating cylinder and the punching and perforating cylinder to the upper shaft;

a lower sloped key pair including a sloped key received in a slot in the lower shaft, a mating sloped key received in a through bore in the die and anvil cylinder, and a screw located above the lower sloped key pair for locking the lower key pair to the die and anvil cylinder and the die and anvil cylinder to the lower shaft;

said punching and perforating cylinder having a plurality of slots, a cross perforating clamping bar and a cross perforating blade received in each of said slots in said punching and perforating cylinder;

said punching and perforating cylinder having a plurality of punches adjacent each end thereof, each of said punches being received in either a hole formed in said punching and perforating cylinder or in a hole formed in said cross perforating clamping bar, and screws for holding said punches in place on said punching and perforating cylinder;

said die and anvil cylinder having a plurality of slots and an anvil bar received in each of said slots in said die and anvil cylinder;

said die and anvil cylinder having a plurality of dies adjacent each end thereof, each of said dies being received in either a hole formed in the die and anvil cylinder or in a hole formed in the anvil bar;

means for setting the dies with respect to the punches and for setting the anvil bars with respect to the cross perforating blades, said setting means including a slip gear circumferentially adjustable on a gear hub mounted on the lower shaft, a yoke secured to the slip gear, a pin received in the gear hub for fine adjustment, and an anti-backlash gear mounted on the upper shaft;

upper locating plates secured to each end of the punching and perforating cylinder for holding the clamping bars in place; and lower locating plates secured to each end of the die and anvil cylinder for holding the anvil bars in place;

whereby quick change and set up of the punching and perforating unit for production of different format sizes of folded continuous webs of paper is facilitated.

* * * * *